US006079060A

United States Patent [19]

Walker

[11] Patent Number: 6,079,060

[45] Date of Patent: Jun. 27, 2000

[54] MULTIPLE SPRAY HEAD SHOWERING FIXTURE

[76] Inventor: Todd A. Walker, P.O. Box 5002, Pleasant Gap, Pa. 16823

[21] Appl. No.: 09/224,315

[22] Filed: Dec. 31, 1998

[51] Int. Cl.[7] ..... A47K 3/22

[52] U.S. Cl. ..... 4/601; 4/605; 4/903

[58] Field of Search ..... 4/601, 605, 903

[56] References Cited

U.S. PATENT DOCUMENTS 3,822,826 7/1974 Wilson ..... 4/601 X 5,333,789 8/1994 Garneys ..... 4/605 X

*Primary Examiner*—Robert M. Fetsuga

[57] ABSTRACT

A multiple spray head showering fixture for spraying water at a user from opposite directions. The multiple spray head showering fixture includes an elongate pipe with spaced apart proximal and distal spray heads coupled thereto. The proximal spray head is positioned towards and spaced apart from a proximal end of the pipe. The distal spray head is positioned adjacent a distal end of the pipe. The pipe has a main valve between the proximal and distal spray heads to selective open and close passage of fluid therethrough from the proximal end of the pipe to the distal spray head.

16 Claims, 2 Drawing Sheets

MULTIPLE SPRAY HEAD SHOWERING FIXTURE

BACKGROUND OF THE INVENTION

1. Field of the Invention

The present invention relates to showering fixtures and more particularly pertains to a new multiple spray head showering fixture for spraying water at a user from opposite directions.

2. Description of the Prior Art

The use of showering fixtures is known in the prior art. More specifically, showering fixtures heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,865,254 by Kragle; U.S. Pat. No. 4,975,993 by Black et al.; U.S. Pat. No. 3,112,073 by Larson et al.; EPO Patent No. EP 0 336 845 A1 by Marielle; U.S. Pat. No. Des. 326,310 by Francoeur; U.S. Pat. No. 1,616,514 by Swimmer; and PCT Patent No. WO 92/02305 by Ward.

While these devices fulfill their respective, particular objectives and requirements, the aforementioned patents do not disclose a new multiple spray head showering fixture. The inventive device includes an elongate pipe with spaced apart proximal and distal spray heads coupled thereto. The proximal spray head is positioned towards and spaced apart from a proximal end of the pipe. The distal spray head is positioned adjacent a distal end of the pipe. The pipe has a main valve between the proximal and distal spray heads to selective open and close passage of fluid therethrough from the proximal end of the pipe to the distal spray head.

In these respects, the multiple spray head showering fixture according to the present invention substantially departs from the conventional concepts and designs of the prior art, and in so doing provides an apparatus primarily developed for the purpose of spraying water at a user from opposite directions.

SUMMARY OF THE INVENTION

In view of the foregoing disadvantages inherent in the known types of showering fixtures now present in the prior art, the present invention provides a new multiple spray head showering fixture construction wherein the same can be utilized for spraying water at a user from opposite directions.

The general purpose of the present invention, which will be described subsequently in greater detail, is to provide a new multiple spray head showering fixture apparatus and method which has many of the advantages of the showering fixtures mentioned heretofore and many novel features that result in a new multiple spray head showering fixture which is not anticipated, rendered obvious, suggested, or even implied by any of the prior art showering fixtures, either alone or in any combination thereof.

To attain this, the present invention generally comprises an elongate pipe with spaced apart proximal and distal spray heads coupled thereto. The proximal spray head is positioned towards and spaced apart from a proximal end of the pipe. The distal spray head is positioned adjacent a distal end of the pipe. The pipe has a main valve between the proximal and distal spray heads to selective open and close passage of fluid therethrough from the proximal end of the pipe to the distal spray head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple spray head showering fixture apparatus and method which has many of the advantages of the showering fixtures mentioned heretofore and many novel features that result in a new multiple spray head showering fixture which is not anticipated, rendered obvious, suggested, or even implied by any of the prior art showering fixtures, either alone or in any combination thereof.

It is another object of the present invention to provide a new multiple spray head showering fixture which may be easily and efficiently manufactured and marketed.

It is a further object of the present invention to provide a new multiple spray head showering fixture which is of a durable and reliable construction.

An even further object of the present invention is to provide a new multiple spray head showering fixture which is susceptible of a low cost of manufacture with regard to both materials and labor, and which accordingly is then susceptible of low prices of sale to the consuming public, thereby making such multiple spray head showering fixture economically available to the buying public.

Still yet another object of the present invention is to provide a new multiple spray head showering fixture which provides in the apparatuses and methods of the prior art some of the advantages thereof, while simultaneously overcoming some of the disadvantages normally associated therewith.

Still another object of the present invention is to provide a new multiple spray head showering fixture for spraying water at a user from opposite directions.

Yet another object of the present invention is to provide a new multiple spray head showering fixture which includes an elongate pipe with spaced apart proximal and distal spray heads coupled thereto. The proximal spray head is positioned towards and spaced apart from a proximal end of the pipe. The distal spray head is positioned adjacent a distal end of the pipe. The pipe has a main valve between the proximal and distal spray heads to selective open and close passage of fluid therethrough from the proximal end of the pipe to the distal spray head.

Still yet another object of the present invention is to provide a new multiple spray head showering fixture that reduces the need to turn around while showering to spray opposite sides of the user's body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
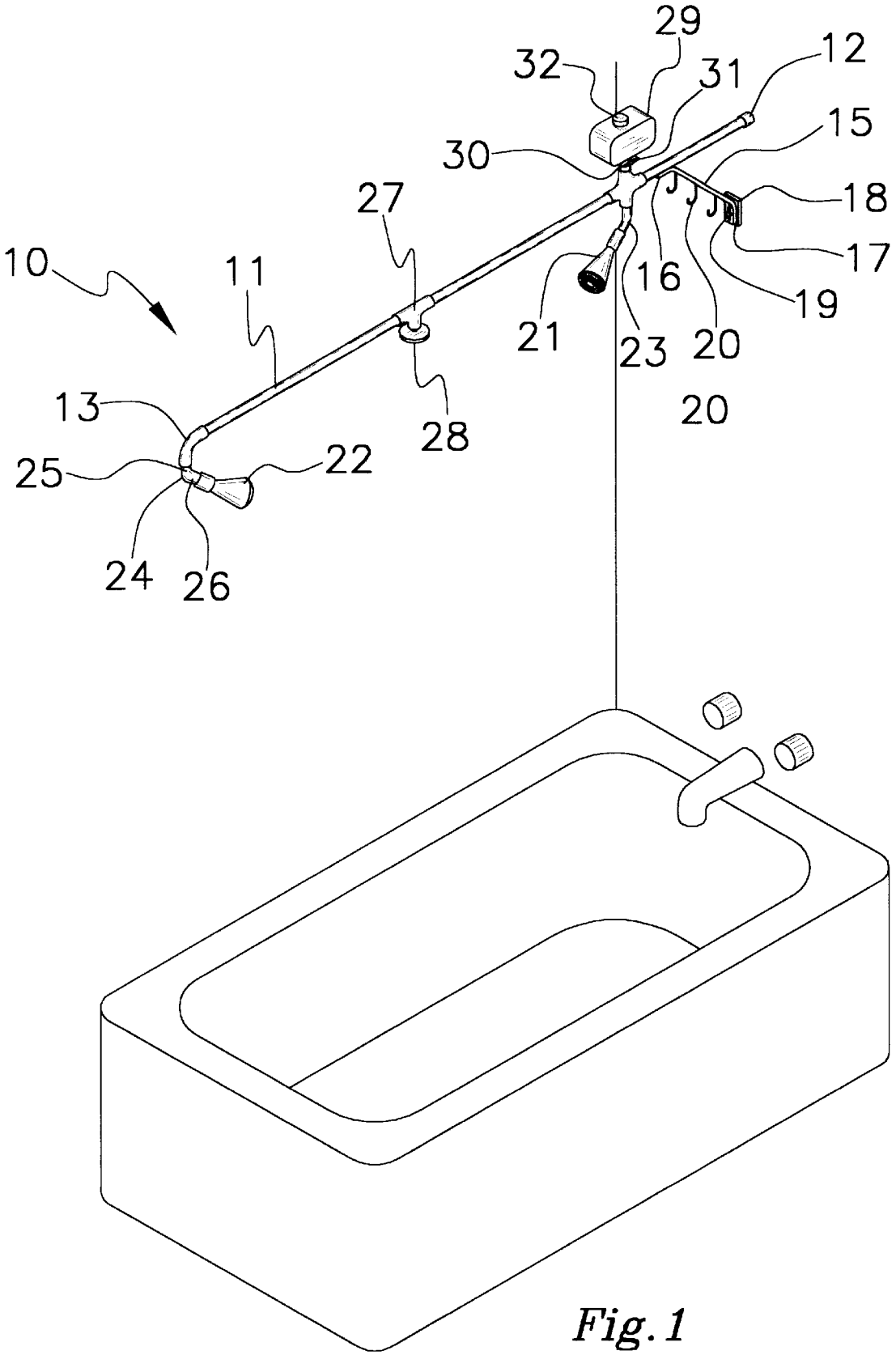
FIG. 1 is a schematic perspective view of a new multiple spray head showering fixture in use according to the present invention in a showering structure.
Figure 2:
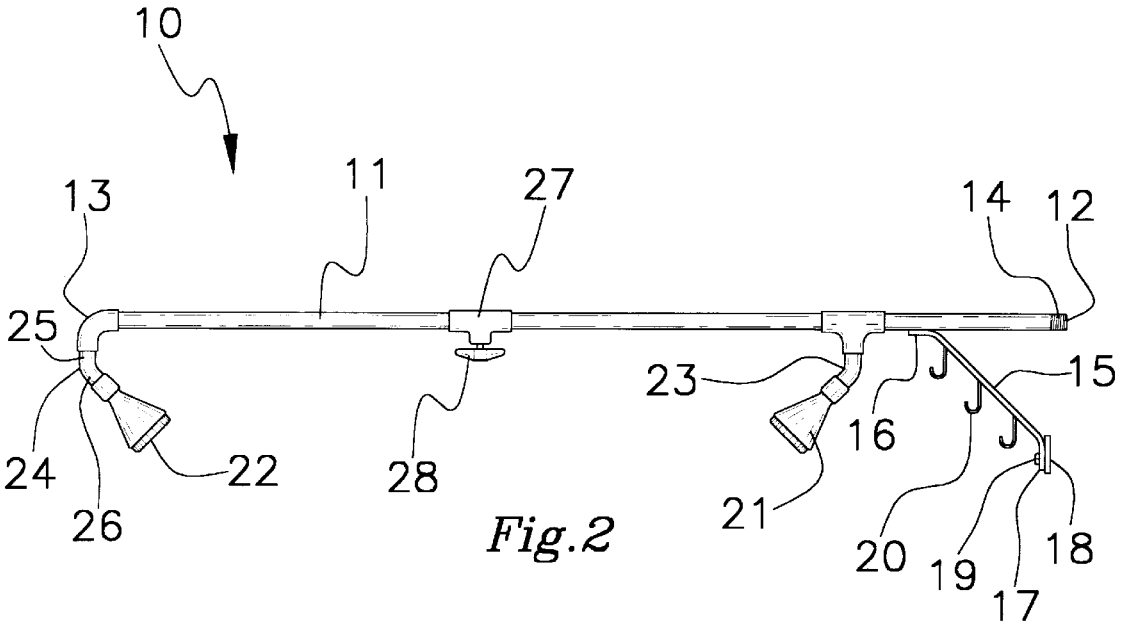
FIG. 2 is a schematic side view of a preferred embodiment of the present invention.
Figure 3:
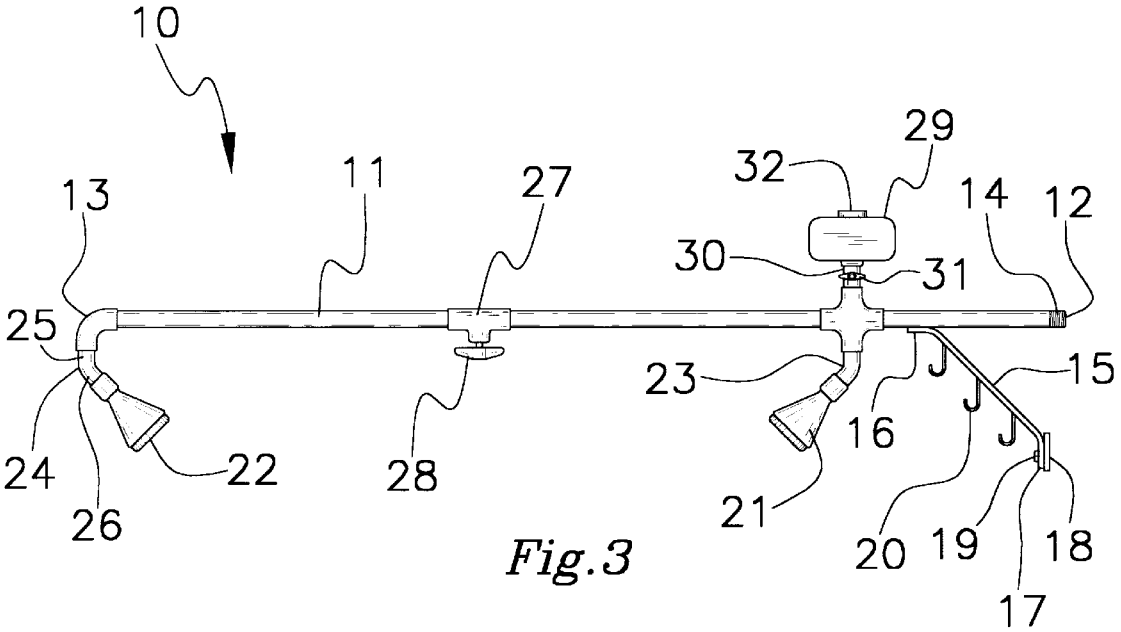
FIG. 3 is a schematic side view of another preferred embodiment of the present invention.

With reference now to the drawings, and in particular to FIGS. 1 through 3 thereof, a new multiple spray head showering fixture embodying the principles and concepts of the present invention and generally designated by the reference numeral 10 will be described.

As best illustrated in FIGS. 1 through 3, the multiple spray head showering fixture 10 generally comprises an elongate pipe with spaced apart proximal and distal spray heads coupled thereto. The proximal spray head is positioned towards and spaced apart from a proximal end of the pipe. The distal spray head is positioned adjacent a distal end of the pipe. The pipe has a main valve between the proximal and distal spray heads to selective open and close passage of fluid therethrough from the proximal end of the pipe to the distal spray head.

In use, the showering fixture 10 is fluidly connectable to a water supply through a conduit in a wall structure of a showering structure such as a bathtub or shower stall. In closer detail, the showering fixture 10 comprises an elongate pipe 11 having opposite proximal and distal ends 12,13 and a longitudinal axis extending between the proximal and distal ends. The pipe preferably has a generally circular transverse cross section taken substantially perpendicular to the longitudinal axis of the pipe. The pipe has a length defined along the longitudinal axis of the pipe between the proximal and distal ends of the pipe and a diameter defined substantially perpendicular to the longitudinal axis of the pipe. In an ideal illustrative embodiment, the length of the pipe is about 44 inches and the diameter of the pipe is about ½ inch.

In use, the proximal end of the pipe is designed for attachment to a conduit in a wall structure of a showering structure such that the pipe is fluidly connected to the conduit of the showering structure and the pipe is outwardly extended from the wall structure of the showering structure. Preferably, the longitudinal axis of the pipe is extended generally perpendicular to the wall structure and ideally horizontal to a floor structure of the showering structure. In a preferred embodiment, the proximal end of the pipe has a threaded portion 14 designed for threaded attachment to the conduit of the showering structure.

Even more preferably, a support brace 15 is provided having first and second ends 16,17 and a longitudinal axis extending between the first and second ends of the support brace. The first end of the support brace is coupled to the pipe and is positioned towards the proximal end of the pipe. The longitudinal axis of the support brace is extended at an acute angle to the longitudinal axis of the pipe. Ideally, the acute angle of the support brace is about 45 degrees. In use, the second end of the support brace is designed for attachment to the wall structure of the showering structure. Preferably, the second end of the support brace has a slot therethrough. A mounting pad 18 is provided with a fastening bolt 19 extending therethrough. The fastening bolt of the mounting pad is inserted through the slot of the second end of the support brace to permit sliding of the fastening bolt along the length of the slot of the second end of the support brace. The fastening bolt of the mounting bad is designed for threadably extending into the wall structure of the showering structure to attach the second end of the support brace to the wall structure of the showering structure.

Ideally, the support brace has a plurality of spaced apart hooks 20 depending therefrom. The hooks of the support brace have an elongate portion preferably extending substantially perpendicular to the longitudinal axis of sad pipe and generally vertical to the floor structure. In use, the hooks of the support brace each are designed for hanging objects such as wash cloths and towels thereon.

The showering fixture also includes proximal and distal spray heads 21,22 depending from the pipe. Each of the spray heads is designed for spraying water therefrom. Ideally, the spray heads are massaging-type spray heads designed for projecting various types of sprays of water therefrom. The proximal spray head is positioned towards and spaced apart from the proximal end of the pipe with the first end of the support brace interposed between the proximal spray head and the proximal end of the pipe. The distal spray head is positioned adjacent the distal end of the pipe.

Preferably, each of the spray head has a connecting conduit 23,24 fluidly connecting the respective spray head to the pipe. Each of the connecting conduits has a bend dividing the respective connecting conduit into upper and lower portions 25,26. The lower portion of each connecting conduit is extended at an obtuse angle from the associated upper portion of the respective connecting conduit. Preferably, the obtuse angles of the connecting conduits are about equal to one another. The lower portions of the connecting conduits extend downwards towards one another such that spray from each of the spray heads is directed in a direction towards a point below the pipe between the spray heads. The upper portions of the connecting conduits are extended substantially perpendicular to the longitudinal axis of the pipe such that the lower portions of the connecting conduits extend at an acute angle with respect to the longitudinal axis of the pipe.

The pipe has a main valve 27 between the proximal and distal spray heads to selective open and close passage of fluid therethrough from the proximal end of the pipe to the distal spray head. The main valve of the pipe is ideally positioned in the pipe about equidistant from the proximal and distal spray heads. The main valve of the pipe preferably has a rotatably mounted turning knob 28 to permit selective opening and closing of the main valve by a user by twisting of the turning knob.

In an ideal embodiment, a container 29 is coupled to the pipe adjacent and above the proximal spray head. The container has a reservoir fluidly connected to the pipe. The reservoir of the container is designed for holding a fluid such as soap, shampoo, or hair conditioner therein such that the fluid in the reservoir container flows into the pipe and out through the spray heads onto a user. The container preferably has a shut-off valve 30 for selectively opening and closing passage of fluid between the reservoir of the container and the pipe. The shut-off valve of the container has a rotatably mounted actuator 31 or lever to permit selective opening and closing of the shut-off valve by a user by twisting of the actuator. The container preferably has an upper opening into the reservoir of the container and a plug 32 substantially closing the upper opening of the container, the upper opening of the container is designed for permitting the filling of the reservoir of the container with fluid.

In use, a user is positioned in the showering structure beneath the showering fixture and in between the proximal and distal spray head so that opposite sides of the user are simultaneously sprayed with water from the spray heads. If the user does not wish to have spray from the distal spray head, the user may turn the turning knob to close the main valve to prevent water from passing through the pipe into the distal spray head. If the user wishes to have soap or shampoo mixed with the water from the spray heads, the user opens the shut-off valve with the actuator to let the soap or shampoo from the reservoir of the container flow into the pipe mix with the water being sprayed out of the spray heads.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A showering fixture, comprising:

an elongate pipe having opposite proximal and distal ends and a longitudinal axis extending between said proximal and distal ends;

spaced apart proximal and distal spray heads being coupled to said pipe;

said proximal spray head being positioned towards and spaced apart from said proximal end of said pipe;

said distal spray head being positioned adjacent said distal end of said pipe;

said pipe having a main valve between said proximal and distal spray heads to selective open and close passage of fluid therethrough from said proximal end of said pipe to said distal spray head;

a support brace having first and second ends and a longitudinal axis extending between said first and second ends of said support brace, said first end of said support brace being coupled to said pipe and being positioned towards said proximal end of said pipe, said second end of said support brace being adapted for attachment to a wall structure of a showering structure; and wherein said longitudinal axis of said support brace is extended at an acute angle to said longitudinal axis of said pipe.

2. The showering fixture of claim 1, wherein said proximal end of said pipe is adapted for attachment to a conduit in a wall structure of a showering structure such that said pipe is fluidly connected to the conduit of the showering structure and said pipe is outwardly extended from the wall structure of the showering structure, wherein said proximal end of said pipe has a threaded portion adapted for threaded attachment to the conduit of the showering structure.

3. The showering fixture of claim 1, wherein said second end of said support brace has a slot therethrough, wherein a mounting pad is provided having a fastening bolt extending therethrough, said fastening bolt of said mounting pad being inserted through said slot of said second end of said support brace to permit sliding of said fastening bolt along said slot of said second end of said support brace, said fastening bolt of said mounting bad being adapted for threadably extending into the wall structure of the showering structure to attach said second end of said support brace to the wall structure of the showering structure.

4. The showering fixture of claim 1, wherein said support brace has a plurality of spaced apart hooks depending therefrom.

5. The showering fixture of claim 1, wherein each of said spray head has a connecting conduit fluidly connecting the respective spray head to said pipe, each of said connecting conduits having a bend dividing the respective connecting conduit into upper and lower portions, said lower portion of each connecting conduit being extended at an obtuse angle from the associated upper portion of the respective connecting conduit.

6. The showering fixture of claim 5, wherein said obtuse angles of said connecting conduits are about equal to one another.

7. The showering fixture of claim 5, wherein said upper portions of said connecting conduits are extended substantially perpendicular to said longitudinal axis of said pipe.

8. The showering fixture of claim 1, further comprising a container being coupled to said pipe adjacent said proximal spray head, said container having a reservoir fluidly connected to said pipe.

9. A showering fixture, comprising:

an elongate pipe having opposite proximal and distal ends and a longitudinal axis extending between said proximal and distal ends;

said pipe having a generally circular transverse cross section substantially perpendicular to said longitudinal axis of said pipe;

said pipe having a length defined along said longitudinal axis of said pipe between said proximal and distal ends of said pipe and a diameter defined substantially perpendicular to said longitudinal axis of said pipe;

said proximal end of said pipe being adapted for attachment to a conduit in a wall structure of a showering structure such that said pipe is fluidly connected to the conduit of the showering structure and said pipe is outwardly extended from the wall structure of the showering structure;

said proximal end of said pipe having a threaded portion adapted for threaded attachment to the conduit of the showering structure;

a support brace having first and second ends and a longitudinal axis extending between said first and second ends of said support brace;

said first end of said support brace being coupled to said pipe and being positioned towards said proximal end of said pipe;

said longitudinal axis of said support brace being extended at an acute angle to said longitudinal axis of said pipe, wherein said acute angle of said support brace is about 45 degrees;

said second end of said support brace being adapted for attachment to the wall structure of the showering structure;

said second end of said support brace having a slot therethrough;

a mounting pad having a fastening bolt extending therethrough, said fastening bolt of said mounting pad being inserted through said slot of said second end of said support brace to permit sliding of said fastening bolt along said slot of said second end of said support brace;

said fastening bolt of said mounting bad being adapted for threadably extending into the wall structure of the showering structure to attach said second end of said support brace to the wall structure of the showering structure;

said support brace having a plurality of spaced apart hooks depending therefrom, said hooks of said support brace having an elongate portion extending substantially perpendicular to said longitudinal axis of sad pipe;

proximal and distal spray heads being depended from said pipe;

said proximal spray head being positioned towards and spaced apart from said proximal end of said pipe, said first end of said support brace being interposed between said proximal spray head and said proximal end of said pipe;

said distal spray head being positioned adjacent said distal end of said pipe;

each of said spray head having a connecting conduit fluidly connecting the respective spray head to said pipe;

each of said connecting conduits having a bend dividing the respective connecting conduit into upper and lower portions;

said lower portion of each connecting conduit being extended at an obtuse angle from the associated upper portion of the respective connecting conduit, wherein said obtuse angles of said connecting conduits are about equal to one another;

said lower portions of said connecting conduits extending towards one another;

said upper portions of said connecting conduits being extended substantially perpendicular to said longitudinal axis of said pipe;

said pipe having a main valve between said proximal and distal spray heads to selective open and close passage of fluid therethrough from said proximal end of said pipe to said distal spray head;

said main valve of said pipe being positioned in said pipe about equidistant from said proximal and distal spray heads;

said main valve of said pipe having a rotatably mounted turning knob to permit selective opening and closing of said main valve by a user;

a container being coupled to said pipe adjacent and above said proximal spray head, said container having a reservoir fluidly connected to said pipe;

said container having a shut-off valve for selectively opening and closing passage of fluid between said reservoir of said container and said pipe; and said shut-off valve of said container having a rotatably mounted actuator to permit selective opening and closing of said shut-off valve by a user.

10. A showering fixture, comprising:

an elongate pipe having opposite proximal and distal ends and a longitudinal axis extending between said proximal and distal ends;

spaced apart proximal and distal spray heads being coupled to said pipe;

said proximal spray head being positioned towards and spaced apart from said proximal end of said pipe;

said distal spray head being positioned adjacent said distal end of said pipe;

said pipe having a main valve between said proximal and distal spray heads to selective open and close passage of fluid therethrough from said proximal end of said pipe to said distal spray head;

a support brace having first and second ends and a longitudinal axis extending between said first and second ends of said support brace, said first end of said support brace being coupled to said pipe and being positioned towards said proximal end of said pipe, said second end of said support brace being adapted for attachment to a wall structure of a showering structure; and wherein said support brace has a plurality of spaced apart hooks depending therefrom.

11. The showering fixture of claim 10, wherein said proximal end of said pipe is adapted for attachment to a conduit in a wall structure of a showering structure such that said pipe is fluidly connected to the conduit of the showering structure and said pipe is outwardly extended from the wall structure of the showering structure, wherein said proximal end of said pipe has a threaded portion adapted for threaded attachment to the conduit of the showering structure.

12. The showering fixture of claim 10, wherein said second end of said support brace has a slot therethrough, wherein a mounting pad is provided having a fastening bolt extending therethrough, said fastening bolt of said mounting pad being inserted through said slot of said second end of said support brace to permit sliding of said fastening bolt along said slot of said second end of said support brace, said fastening bolt of said mounting bad being adapted for threadably extending into the wall structure of the showering structure to attach said second end of said support brace to the wall structure of the showering structure.

13. The showering fixture of claim 10, wherein each of said spray head has a connecting conduit fluidly connecting the respective spray head to said pipe, each of said connecting conduits having a bend dividing the respective connecting conduit into upper and lower portions, said lower portion of each connecting conduit being extended at an obtuse angle from the associated upper portion of the respective connecting conduit.

14. The showering fixture of claim 13, wherein said obtuse angles of said connecting conduits are about equal to one another.

15. The showering fixture of claim 13, wherein said upper portions of said connecting conduits are extended substantially perpendicular to said longitudinal axis of said pipe.

16. The showering fixture of claim 10, further comprising a container being coupled to said pipe adjacent said proximal spray head, said container having a reservoir fluidly connected to said pipe.

* * * * *